US006937202B2

(12) United States Patent
Chandler

(10) Patent No.: US 6,937,202 B2
(45) Date of Patent: Aug. 30, 2005

(54) BROADBAND WAVEGUIDE HORN ANTENNA AND METHOD OF FEEDING AN ANTENNA STRUCTURE

(75) Inventor: Charles Winfred Chandler, Palm Harbor, FL (US)

(73) Assignee: Northrop Grumman Corporation, Los Angeles, CA (US)

( * ) Notice: Subject to any disclaimer, the term of this patent is extended or adjusted under 35 U.S.C. 154(b) by 72 days.

(21) Appl. No.: 10/441,824

(22) Filed: May 20, 2003

(65) Prior Publication Data

US 2004/0233119 A1 Nov. 25, 2004

(51) Int. Cl.[7] ..... H01Q 13/00
(52) U.S. Cl. ..... 343/786
(58) Field of Search ..... 343/786, 880; 333/21 A, 208, 126, 135

(56) References Cited

U.S. PATENT DOCUMENTS 5,359,339 A 10/1994 Agrawal et al.
5,389,939 A 2/1995 Tang et al.
5,736,907 A 4/1998 Chen et al.
5,870,060 A 2/1999 Chen et al.
5,903,241 A * 5/1999 Bhattacharyya ..... 343/786
6,163,304 A 12/2000 Peebles et al.
6,271,799 B1 8/2001 Rief et al.
6,313,714 B1 11/2001 Junker et al.
6,396,453 B2 * 5/2002 Amyotte et al. ..... 343/786
6,441,795 B1 8/2002 Volman
6,549,173 B1 * 4/2003 King et al. ..... 343/772
6,759,992 B2 * 7/2004 Knop et al. ..... 343/786
2002/0186174 A1 * 12/2002 Matsumoto et al. ..... 343/786

* cited by examiner

*Primary Examiner*—Wilson Lee
*Assistant Examiner*—Minh Dieu A
(74) *Attorney, Agent, or Firm*—Tarolli, Sundheim, Covell & Tummino L.L.P.

(57) ABSTRACT

A waveguide horn antenna includes a horn-shaped body portion and one or more feed structures. Each feed structure includes feed locations positioned between spaced apart ends of the body portion according to short circuit locations of desired frequencies to facilitate propagation of electromagnetic energy at the desired frequencies. Multiple frequency bands can be supported with the antenna by employing more than one axially spaced apart feed structures having associated feed locations arranged along the body portion of the antenna.

24 Claims, 7 Drawing Sheets

BROADBAND WAVEGUIDE HORN ANTENNA AND METHOD OF FEEDING AN ANTENNA STRUCTURE

TECHNICAL FIELD

The present invention relates generally to communications and, more particularly, to a broadband waveguide horn antenna.

BACKGROUND OF THE INVENTION

Various communications systems employ horn antenna structures for transmitting and/or receiving electromagnetic signals. A horn antenna structure typically includes a horn attached to or otherwise formed at the end of a waveguide. The horn shape affords a gradual transition to free space, which mitigates mismatch or reflections at the open end. The dimensions and configurations of the horn can be selected to produce a desired radiation pattern and a desired amount of antenna gain. The area of the output aperture (e.g., height times width) determines the amount of antenna gain the horn will exhibit. The larger the output aperture, the more gain the antenna will exhibit.

Traditionally, conical horns provided only the $TE_{11}$ mode, where the E-plane beamwidth is substantially less than the H-plane beamwidth. Consequently, when such traditional horns were used to transmit or receive a circularly polarized signal, the signals were not sufficiently circularly polarized, but instead were elliptically polarized. Potter horns and corrugated horns were developed to reduce the axial ratio and provide a highly circularly polarized beam over a narrow bandwidth. The Potter and corrugated horns generate substantially equal E-plane and H-plane patterns with suppressed sidelobes. The Potter horn is a conical shaped feed horn that includes a single step transition that provides for the propagation of the $TM_{11}$ mode for equal E-plane and H-plane beamwidths and suppressed sidelobes. The corrugated horn is a conical shaped feed horn that includes a corrugated structure within the horn from the waveguide to the aperture that also provides substantially equal E and H plane beamwidth and suppresses the sidelobes.

Waveguides having a circular or rectangular cross-section, which are referred to as circular or rectangular waveguides, respectively, are used in high frequency (HF) applications for transmitting HF signals. The interior space of a waveguide can be filled with air or with a solid dielectric material, for example. As noted above, an antenna, such as a horn or antenna, is arranged at one end of a waveguide for radiating or receiving HF signals relative to free space.

Present methods of feeding a multi-frequency horn antenna include a broadband feed structure that usually consists of many, multiple wavelength sections of waveguides. The multiple sections of waveguides are configured to couple from the waveguide to the feed to the antenna structure. Such feed mechanisms tend to be quite large volume since the feed structure dimensions depend on the frequency of the horn antenna structure. Additionally, the frequency range for such conventional feed structures may be limited because the entire feed structure is often required to cover multiple octave bandwidths simultaneously.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

The present invention relates generally to a waveguide horn antenna structure, which integrates a horn antenna structure and a waveguide. This results in an antenna structure that is capable of increased bandwidth with a smaller antenna feed structure relative to conventional feed structures.

In accordance with an aspect of the present invention, the waveguide antenna includes a body portion having a generally conical sidewall section extending between first and second ends of the sidewall section. A feed structure is arranged in electromagnetic communication with the body portion between the ends of the body portion to facilitate propagation of electromagnetic energy at desired frequencies. The feed structure includes plural axially spaced apart feed locations, which are functionally related to short circuit locations for desired frequencies in one or more frequency bands supported by the antenna. The number of feed locations for supporting a particular frequency band at the respective axial locations may vary depending on the type of polarization (e.g., linear or circular) supported by the antenna structure.

To the accomplishment of the foregoing and related ends, certain illustrative aspects of the invention are described herein in connection with the following description and the annexed drawings. These aspects are indicative, however, of but a few of the various ways in which the principles of the invention may be employed and the present invention is intended to include all such aspects and their equivalents. Other advantages and novel features of the invention will become apparent from the following detailed description of the invention when considered in conjunction with the drawings.

DETAILED DESCRIPTION OF INVENTION

The present invention relates generally to a waveguide antenna having a horn-shaped body portion (that may or may not be flared) and one or more feed structures. The feed structures are located between spaced apart ends of the body portion according to short circuit locations of desired center frequencies. For a structure supporting multiple frequency bands, for example, the feed structures can be configured to feed the body portion at axially spaced apart locations of the body portion according to respective short circuit locations of desired frequencies in each respective band. Thus, each axially positioned feed structure can cover a certain frequency range. As a result of this arrangement, a wider frequency band can be achieved for the antenna. This approach further enables a reduction in size for the overall antenna structure for a broader frequency range.

Figure 1:
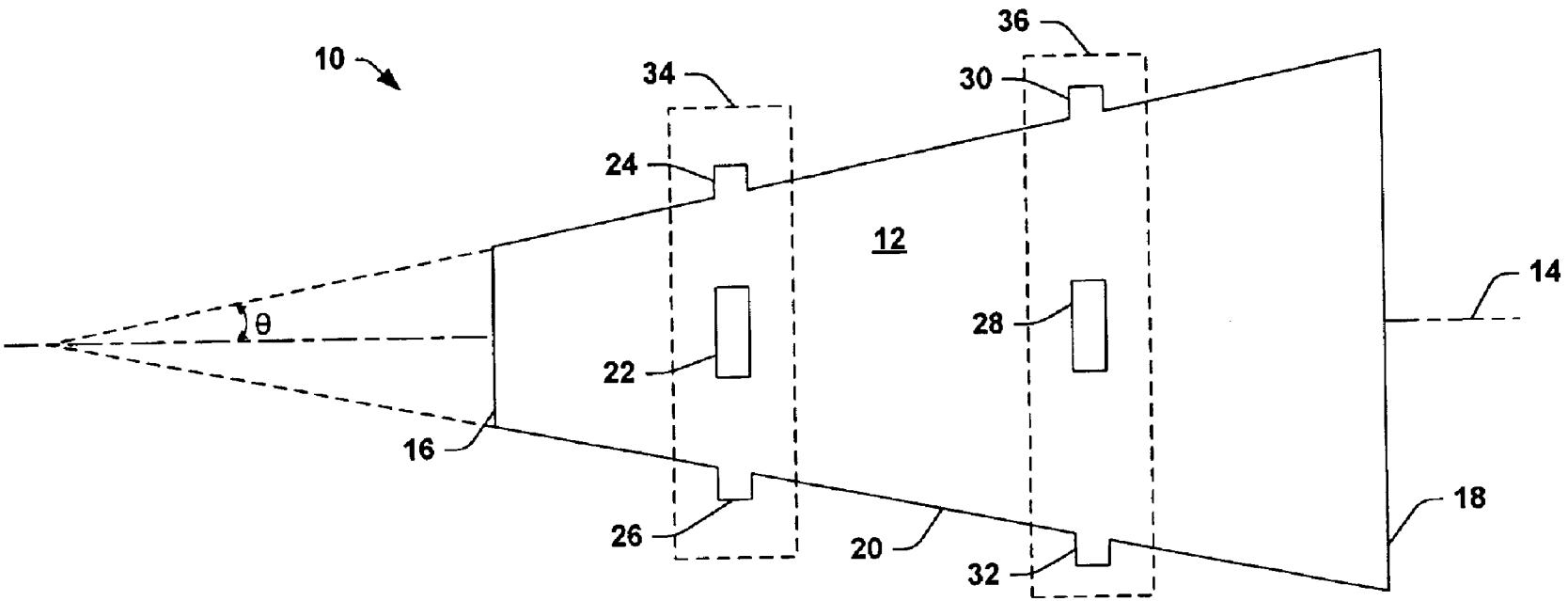
FIG. 1 illustrates a schematic block diagram of a waveguide antenna accordance with an aspect of the present invention.

FIG. 1 is an example of a waveguide horn antenna structure 10 in accordance with an aspect of the present invention. The antenna structure 10 includes an elongated horn-shaped body portion 12 having a central longitudinal axis 14 that extends through ends 16 and 18 of the antenna. The end 16 has a smaller cross-sectional dimension than the opposite end 18, which end 18 defines an input/output aperture of the antenna 10. The difference between cross-sectional dimensions of the ends 16 and 18 determines a flare angle θ of the body portion 12. The body portion 12 has a sidewall portion 20 that extends between the ends 16 and 18 according to the horn geometry.

For example, the body portion 12 can have a generally rectangular cross-section, a generally circular cross-section, a generally elliptical cross-section, as well as other geometrically shaped cross-sections. Those skilled in the art will understand and appreciate that the dimensions and configurations of the antenna body portion 12 thus can be selected to produce a desired radiation pattern and a desired amount of antenna gain.

The antenna 10 also includes one or more feed structures 22, 24, 26, 28, 30 and 32 operatively associated with the body portion 12 to facilitate propagation of electromagnetic energy relative to the antenna. That is, the feed structures 22–32 can receive electromagnetic energy from and/or transmit electromagnetic energy to an interior of the body portion 12 of the antenna 10. For example, the coupling can be implemented at each feed structure 22–32 by one or more feed elements, which can include probes, loops, slots or a combination thereof. Each feed element couples over a limited part of a broader frequency band that is supported by its associated feed structure 22–32.

In accordance with an aspect of the present invention, the feed elements within each feed structure 22–32 are positioned as a function of desired center frequencies. More particularly, a virtual short circuit location is determined at an axial position along the body portion for each of a plurality of desired center (or cut-off) frequencies within each frequency band. The short circuit locations correspond to a position along the body portion 12 of the antenna structure 10 where no waveguide modes can propagate for the corresponding frequency. A corresponding feed location can then be determined based on the predetermined short circuit position, such as a distance of approximately one-quarter wavelength spaced axially outwardly from the short circuit position.

To facilitate propagation of electromagnetic waves at or near the desired center frequency, the interior of the body portion 12 can be corrugated or dielectrically loaded. In a corrugated structure, the location and dimensions of the corrugations can vary according to the center frequency being fed at each feed location. Thus, it will be appreciated that feed structure matching can be built into the antenna structure according to an aspect of the present invention.

In the example of FIG. 1, the antenna 10 is depicted as a dual polarized waveguide horn antenna. The feed structures 22, 24 and 26 together with another feed structure (not shown) define a set 34 of feed structures that are associated with a corresponding set of short circuit locations. In particular, the feed structures 24 and 26 provide feed elements for electromagnetic waves having a first polarization (e.g., horizontal polarization), the respective feed elements in each being approximately 180 degrees out of phase with each other. The feed elements in the feed structure 22 are about 180 degrees out of phase with corresponding feed elements in another feed structure (not shown) for providing electromagnetic waves having a second polarization (e.g., vertical polarization), which is different from the first polarization. The feed structures 24 and 26 are ±90 degrees out of phase with respect to the structures 22 and the structure not depicted in FIG. 1. The feed elements in each of the feed structures 22–26 in the set 34 can be configured to propagate electromagnetic energy in the same frequency band, with individual feeds in each structure positioned to feed at different desired frequencies within that band. As a result, the each feed structure can be configured to support all frequencies within a given frequency band.

Similarly, the feed structures 28, 30 and 32 together with another feed structure (not shown) define a second set 36 of feed structures that are associated with a corresponding set of short circuit locations spaced axially apart from those of set 34. The feed structures 30 and 32 provide feed elements for propagating electromagnetic energy within an associated frequency band and having a first polarization (e.g., horizontal polarization). The respective feed elements in each respective feed structure 30, 32 are approximately 180 degrees out of phase with each other. Similarly, the feed elements in the feed structure 28 are approximately 180 degrees out of phase with corresponding feed elements in its associated feed structure (not shown) for propagating electromagnetic energy within the same associated frequency band, but having a second polarization (e.g., vertical polarization), which is different from the first polarization. The set 34 of feed structures 22–26 supports a higher frequency band than the feed structures 28–32 in the set 36.

Those skilled in the art will understand and appreciate that waveguide horn antennas having other types of polarization and/or numbers of feed sets can be implemented in accordance with an aspect of the present invention. By way of example, there can be one or more feed set, with each feed structure in each set having typically two or more feed elements associated with different center frequencies in an associated frequency band. Generally, the number of feed structures and frequency bands supported in the antenna structure will determine the length and total bandwidth of the antenna. Typically, dividing and phasing circuitry (not shown) includes a power divider to split a signal 180 degrees. The divider provides the respective signals to a quadrature coupler that further shifts the signal 90 degrees apart and provides the quadrature signals to the respective feeds for a given frequency range. Those skilled in the art will appreciate that different combinations of power dividers and quadrature couplers can be utilized, for example, depending on the type of polarization being implemented at a given set of feed structures.

Figure 2:
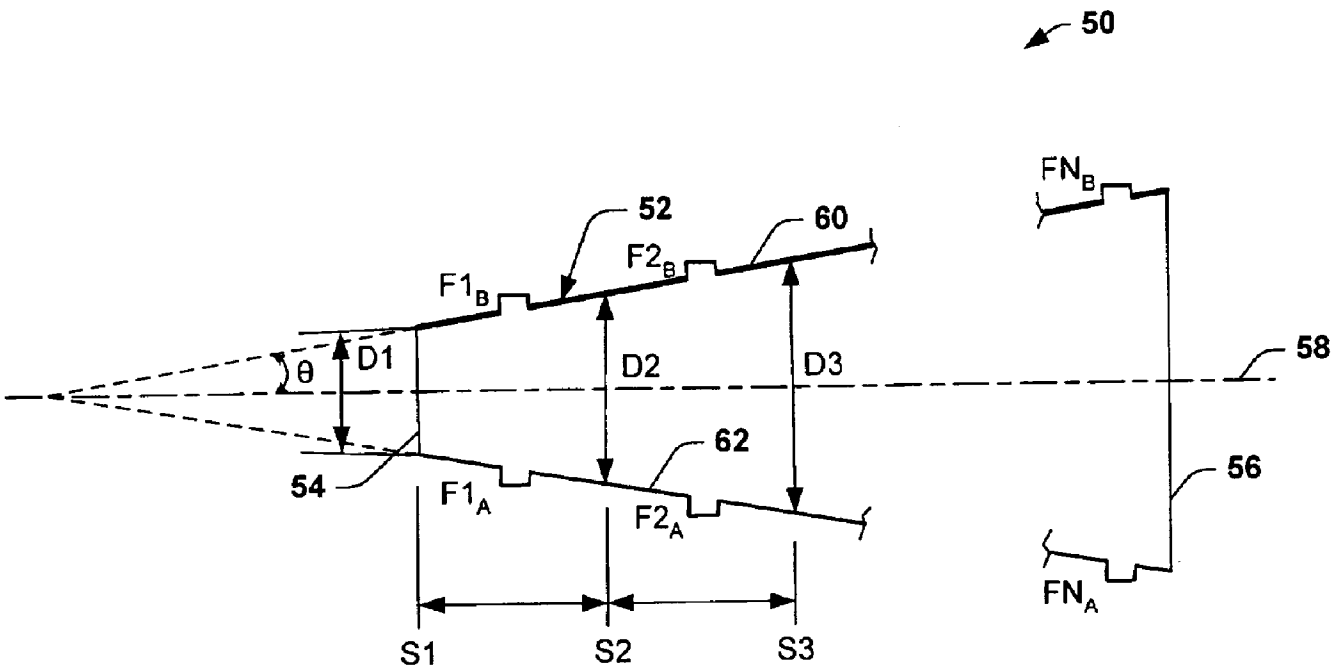
FIG. 2 illustrates a cross sectional view of a waveguide antenna implemented in accordance with an aspect of the present invention.

A general design for a waveguide horn antenna structure 50, in accordance with an aspect of the present invention, will be better appreciated with reference to FIG. 2. The antenna structure 50 includes a body portion 52 that extends between end portions 54 and 56. A central axis 58 extends longitudinally through the ends 54 and 56 of the antenna body 52. The body portion 52 includes a sidewall portion 60 that has a desired geometrical cross-section, which can be circular, rectangular and so forth. For purposes of simplification of explanation only, a circular cross-section for the body portion 52 is assumed in the following examples. Those skilled in the art will understand and appreciate that the present invention is equally applicable to other geometrical configurations of horn structures.

The antenna structure 50 is designed to have a diameter D1 at end 54 dimensioned according to a highest desired frequency to be supported by the antenna structure. Alternatively, the diameter for the highest frequency could be axially spaced from the end 54. For example, the desired frequency times the diameter is a fundamental constant, which can be expressed as follows:

$$f_C * d = \frac{x'_{mn} * c}{\pi} \qquad \text{Eq. 1}$$

where $f_c$=desired center frequency d=diameter (cm)

$x'_{mn}$=the $n^{th}$ positive root of the $m^{th}$ order Bessel function, which for the $TE_{11}$ mode $x'_{11}$=1.841; and $c=2.998\times10^{10}$ cm/s (the speed of light)

Solving for d, Eq. 1 becomes:

$$d = \frac{x'_{mn} * c}{\pi * f_C} \qquad \text{Eq. 2}$$

Thus, the diameter d of the antenna structure 50 at a given short circuit location is inversely proportional to the desired center frequency corresponding to such short circuit location. By way of example, assuming a center frequency of about 20 GHz and a 10% bandwidth (e.g., about 200 MHz) for each center frequency, a highest frequency of about 21 GHz can be accommodated in the antenna structure. Thus, for the dominant $TE_{11}$ mode in a circular waveguide, the diameter D1 is computed from Eq. 2 to be about 0.8366 cm. For the highest short circuit location, its axial location along the antenna can be assumed to be zero (e.g., the end 54), although other axial locations could be utilized as the short circuit location for the highest frequency to be supported by the antenna structure 50. For example, the axial location having the diameter D1 corresponds to a first short circuit location S1 for the antenna 50 (e.g., S1=0.0 cm).

The axial position of the remaining short circuit locations $S_n$ (where n is a positive integer for referencing different short circuit locations in a given frequency band) can be determined by the following equation:

$$S_n = \frac{\frac{d_n - d_{n-1}}{2}}{\tan\theta} \qquad \text{Eq. 3}$$

where: $d_n$=diameter at short circuit location n;

$d_{n-1}$=diameter at short circuit location n−1; and

θ=flare angle of antenna at short circuit location.

The short circuit location S1 has an associated feed structure $F1_A$ having one or more feed elements operative to feed electromagnetic waves at frequencies within in an associated frequency band for the feed structure $F1_A$. The locations of the feed elements in the feed structure $F1_A$ are spaced axially down the horn from the short circuit location a distance functionally related to the wavelength of the corresponding short circuit location S1. Specifically, each feed location is set to be approximately one-quarter wavelength from the corresponding short circuit location. For example, with the sidewall 60 of the body portion 52 having an inner diameter of about 0.8366 cm for the short circuit location S1, the corresponding feed element in feed structure $F1_A$ is spaced axially approximately 0.3318 cm from S1.

Plural short circuit locations and their associated feed locations can be determined for desired center frequencies within each frequency band. By way of example, Table 1 below represents part of an antenna design for a frequency band of 11–21 GHz, assuming a 10 degree flare or taper angle for the antenna body portion 52 and a 10% bandwidth for each desired frequency in the range. That is, the feed locations in Table 1 represent feed locations for plural feed elements associated with a single feed structure, such as the feed structure F1A illustrated in FIG. 2.

In Table 1, n identifies a reference number for given short circuit location, each of which is associated with a desired center frequency. $F_{LOW}$ and $F_{HIGH}$ correspond respectively to the low and high frequencies for each location n, which are determined based on the bandwidth (BW) and the selected center frequencies ($F_c$). The diameters (d) for each short circuit location are utilized to compute an axial position for the short circuit locations (SC), such as based on Eq. 3. Each feed element in the feed structure (e.g., $F1_A$) is coupled to propagate electromagnetic waves in the antenna structure 50 at feed locations determined according to the desired center frequency and corresponding short circuit locations.

As mentioned above, the feed locations (FEED) can be calculated as the quarter wavelength positions spaced axially from the respective short circuit locations (SC). To help ensure that the feed locations are not at the same position as the next frequency band, the feed location $FEED_n$ for short circuit location $S_n$ can be determined as a function of the average diameters for the short circuit location $S_n$ and the next circuit location $S_{n+1}$, such as according to the following equation:

$$FEED_n = \frac{0.293}{\frac{1}{2}(d_n + d_{n+1})} + S_n \qquad \text{Eq. 4}$$

where dn=diameter of short circuit location dn+1=diameter of next short circuit location; and Sn=axial position of short circuit location.

TABLE 1

| n | $F_{LOW}$ | $F_{HIGH}$ | BW | $F_C$ | d (cm) | SC | FEED |
|---|---|---|---|---|---|---|---|
| 1 | 1.900E+10 | 2.100E+10 | 2.000E+09 | 2.000E+10 | 0.8366 | 0.0000 | 3.318E−01 |
| 2 | 1.710E+10 | 1.890E+10 | 1.800E+09 | 1.800E+10 | 0.9296 | 0.5312 | 8.299E−01 |
| 3 | 1.539E+10 | 1.701E+10 | 1.620E+09 | 1.620E+10 | 1.0328 | 1.1215 | 1.390E+00 |
| 4 | 1.385E+10 | 1.531E+10 | 1.458E+09 | 1.458E+10 | 1.1476 | 1.7774 | 2.019E+00 |

TABLE 1-continued

| n | $F_{LOW}$ | $F_{HIGH}$ | BW | $F_C$ | d (cm) | SC | FEED |
|---|---|---|---|---|---|---|---|
| 5 | 1.247E+10 | 1.378E+10 | 1.312E+09 | 1.312E+10 | 1.2751 | 2.5061 | 2.724E+00 |
| 6 | 1.122E+10 | 1.240E+10 | 1.181E+09 | 1.181E+10 | 1.4168 | 3.3158 | 3.512E+00 |
| 7 | 1.010E+10 | 1.116E+10 | 1.063E+09 | 1.063E+10 | 1.5742 | 4.2154 | |

In the example of FIG. 2, the feed structure $F1_B$ can include feed elements located at substantially the same axial positions as the feed elements of the feed structure $F1_A$, although the feed elements of $F1_B$ are oriented 180 degrees out of phase relative to the feed elements of $F1_A$. In this way, each of the feed structures can propagate waves at the same frequencies and polarization, although 180 degrees out of phase.

For a dual polarized horn waveguide system, there is also another pair of feed structures for propagating waves having a different polarization from those propagated via $F1_A$ and $F1_B$. The axial short circuit and feed locations for feed elements of these other (differently polarized) feed structures can be the same as for $F1_A$ and $F1_B$. Such differently polarized feed elements are 90 degrees out of phase with respective feed elements in the illustrated feed structures $F1_A$ and $F1_B$. For example, the illustrated feed structures $F1_A$ and $F1_B$ can provide horizontal polarization and the other feed structures (not shown and 90 degrees out of phase) can provide vertical polarization, or vice versa. The two pairs of feed structure thus provide a four port feed system for the antenna structure 50 for supporting a common frequency band.

An interior sidewall 62 of the body portion 52 can include corrugations in accordance with an aspect of the present invention. For simplicity of illustration, such corrugations are not depicted in the example of FIG. 2. The corrugations are defined by an alternating arrangement of radially inwardly protruding portions (or ribs) and recessed portions (or slots) disposed circumferentially along the interior sidewall 62 of the body portion 52. The corrugations are provided at locations for each feed structure according to the center frequency corresponding wavelength associated with each associated feed element. The dimensions and configuration of the corrugations can further vary depending on the type of feed element employed to feed at the particular center frequency. For example, some types of feed elements can be electromagnetically coupled to an inwardly radially protruding portion, while another type of feed element may be coupled to a recessed portion of the corrugations. Examples of some different types of feed elements are shown and described herein below.

Those skilled in the art will understand and appreciated that the foregoing approach can be utilized to provide additional feed structures $F2_A$, $F2_B$, $FN_A$ and $FN_B$ on the same antenna structure 50, where N denotes a positive integer indicating the number axial sets of feed structures. Each of the feed structures is designed to cover a certain frequency band. As a result, each feed structure does not have to be designed to cover the entire frequency range supported by the antenna structure 20, which is typically the case for conventional broadband horn antenna structures. This further enables the waveguide horn antenna to support a broader bandwidth.

For example, a waveguide horn antenna configured in accordance with an aspect of the present invention can feasibly achieve a positive bandwidth ratio, such as a 2:1 or even 10:1 ratio of bandwidth to frequency. This is compared to conventional antenna structures that typically provide fractional bandwidth ratios, such as about 1:10 or even less for a comparably sized structure. Additionally, those skilled in the art will understand and appreciate that an antenna structure implemented in accordance with an aspect of the present invention enables smaller antenna feed structures than conventional antenna structures. This is because feed structures implemented in accordance with an aspect of the present invention are not required to support multiple octave bandwidths (e.g., Ku and Ka bands) simultaneously, as in many conventional antenna structures.

Figure 3:
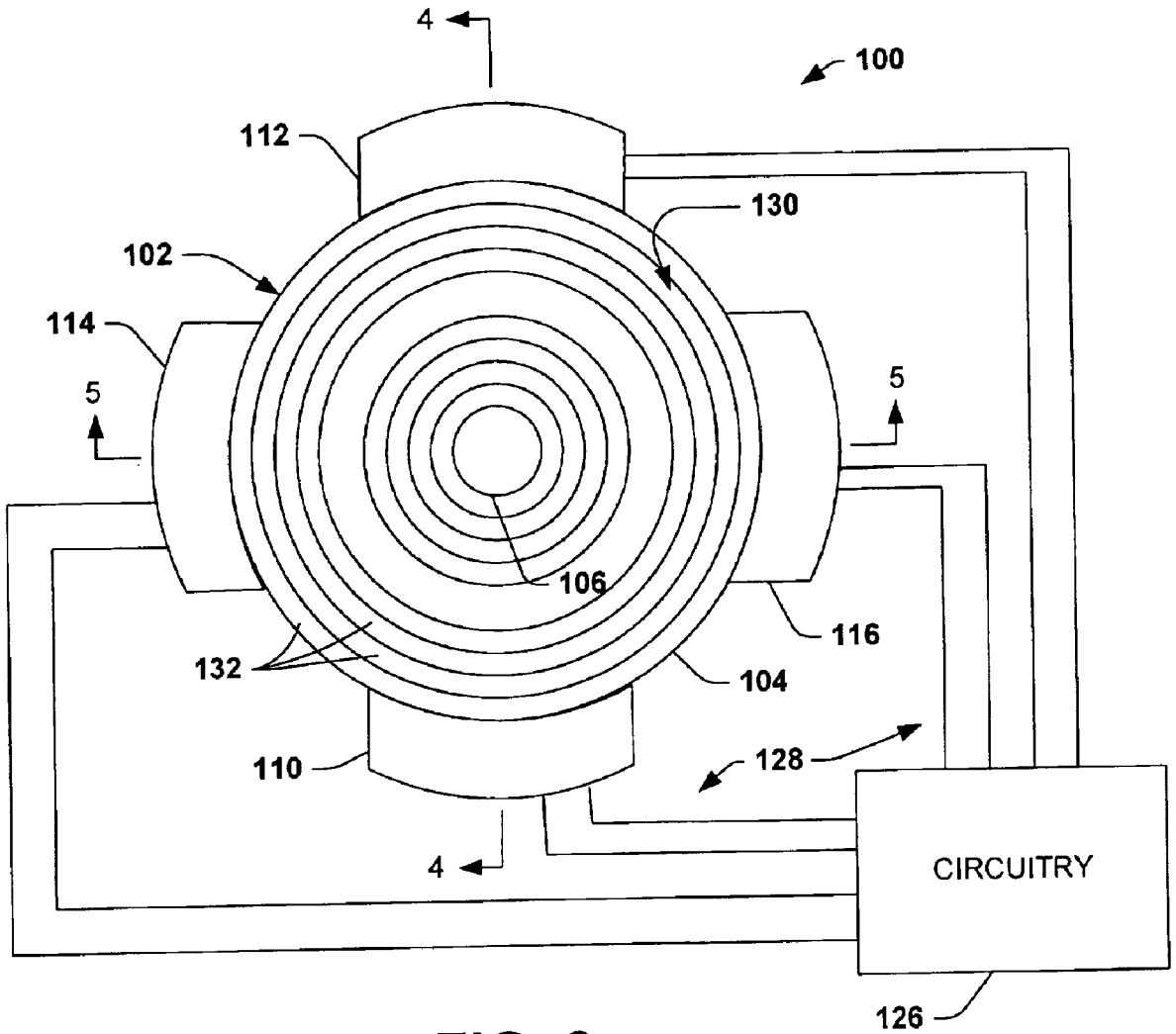
FIG. 3 is a view of an open end of a waveguide antenna in accordance with an aspect of the present invention.
Figure 4:
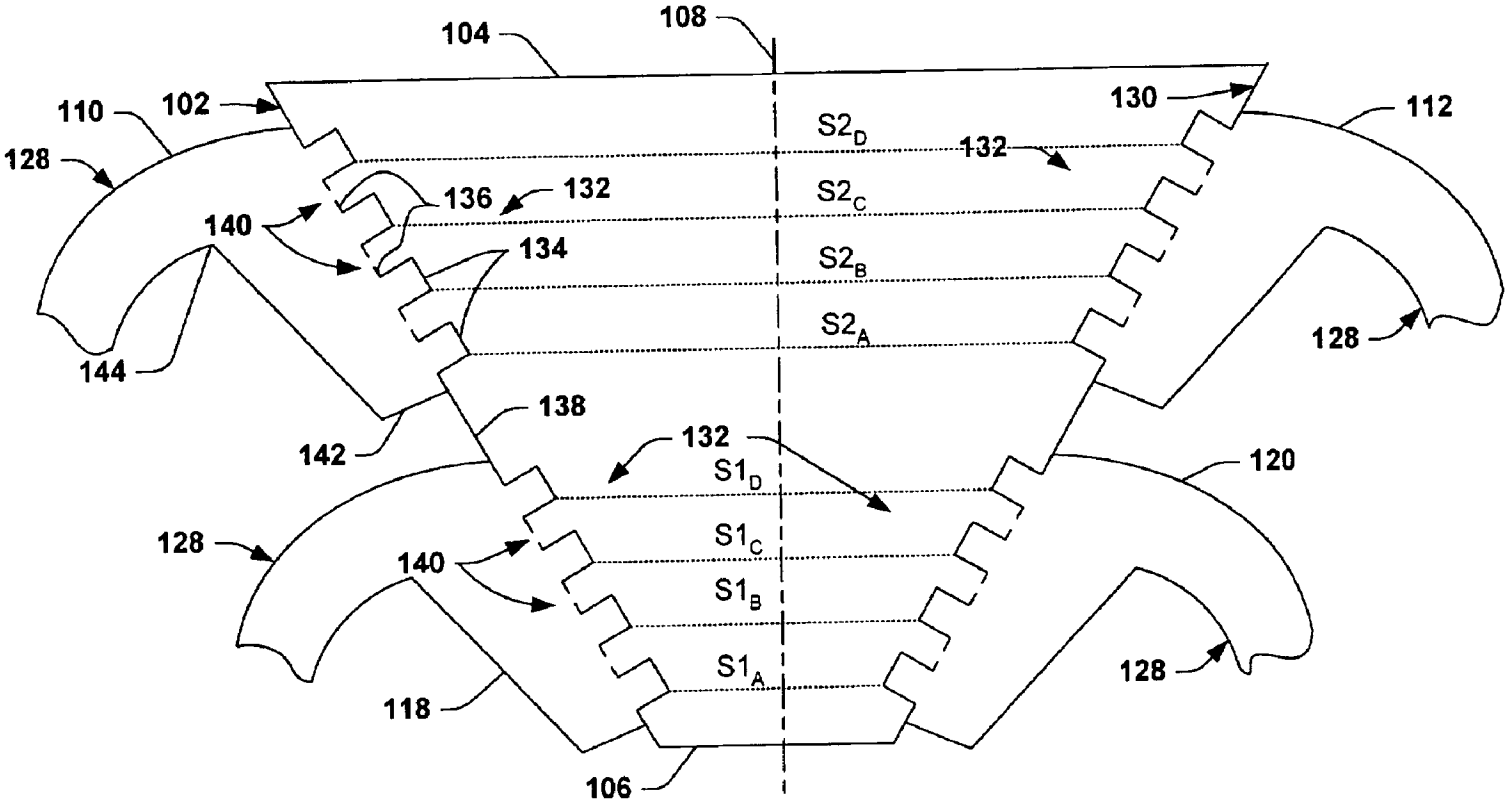
FIG. 4 is a sectional view of a waveguide antenna taken along line 4—4 of FIG. 3 illustrating feed ports having a first polarization.
Figure 5:
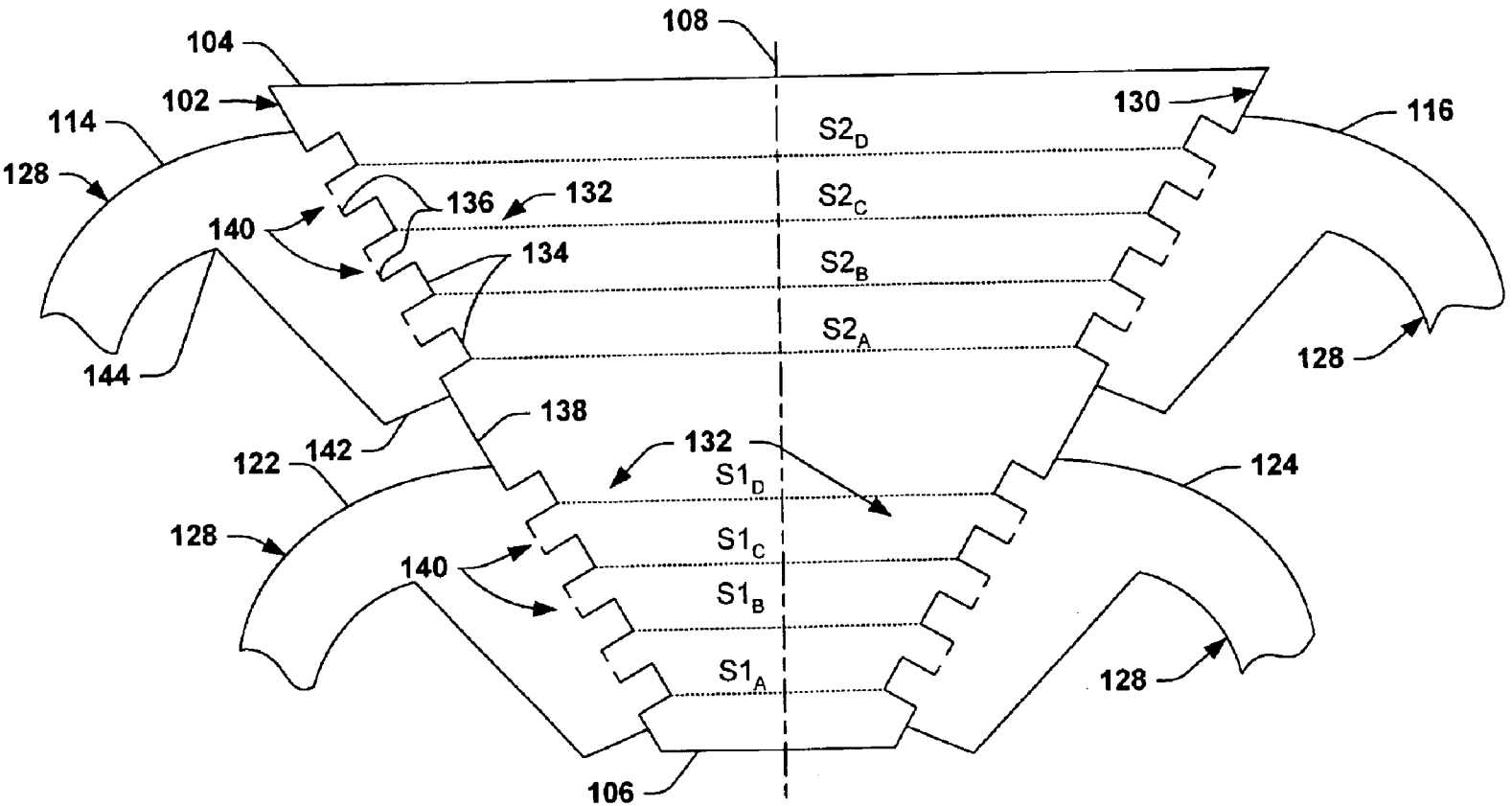
FIG. 5 is a sectional view of a waveguide antenna taken along line 5—5 of FIG. 3 illustrating feed ports having a second polarization.

FIGS. 3–5 depict an example of a waveguide horn antenna structure 100 implemented in accordance with an aspect of the present invention. In this example, the antenna 100 has a generally conical sidewall body portion 102 extending between axially spaced apart ends 104 and 106. A central axis 108 extends through the ends 104 and 106. The diameter at end 104 is greater than the diameter at 106, such that the sidewall body portion 102 interconnecting the ends tapers according to a flare angle of the body portion 102. While in this example, the body portion 102 is shown and described as having a constant flare angle, those skilled in the art will understand and appreciate that different axial sections of the body portion can be implemented with different flare angles, which can range between about zero degrees and about 90 degrees. Additionally or alternatively, the flare angle can be different for discrete axial sections of the body portion 102 or, alternatively, the flare angle can vary (e.g., increase over then length of the antenna from end 106 to end 104, such as to provided an axially outwardly curving body portion.

The antenna structure 100 also includes a plurality of feed structures 110, 112, 114, 116, 118, 120, 122 and 124 that are operative to propagate electromagnetic energy relative to the antenna. A first set of the feed structures 110–116 are operatively associated with a first axial section of the body portion 102 for propagating electromagnetic energy within a first frequency band. Similarly, the feed structures 118–124 are operatively associated with a second axial section of the body portion 102 for propagating electromagnetic energy within a second frequency band. In the example of FIGS. 3–5, the second frequency band is different from (e.g., higher than) the first frequency range. The frequency bands supported by each of the different axial sets of feed structures collectively determine the broadband frequency range of the antenna structure 100.

The particular arrangement of feed structures 110–124 depicted in FIGS. 3–5 corresponds to a dual polarized waveguide horn antenna structure 100. That is, the feed structures 110 and 112 are arranged approximately 180 degrees out of phase from each other and are configured to propagate electromagnetic energy having a first (e.g., horizontal) polarization. The feed structures 118 and 120 are also approximately 180 degrees out of phase from each other and are configured to propagate electromagnetic energy having such polarization, although in a higher frequency band. The other pairs of feed structures 114, 116 and 122, 124 are similarly arranged 180 degrees out of phase with each other and configured to propagate electromagnetic energy having a different (e.g., vertical) polarization. Thus, the feed structures depicted in FIGS. 3–5 support both vertical and horizontal polarization so as to provide the antenna structure with dual polarization via four feed structures (or ports) at each frequency band.

As shown in FIG. 3, circuitry 126, which can include a transmitter, receiver or both, is operative to send or receive electromagnetic waves relative to the respective feed structures, such as by employing dividing and phasing circuitry configured for a given type of polarization. The circuitry 126 is coupled to the respective feed structures 110–124 via feed input connections, schematically represented at 128. It is to be appreciated that the input connections can be electrically conductive elements (e.g., wire) or can be waveguides. Those skilled in the art will understand and appreciate various types of transmitter and receiver circuitry that can be utilized to provide the circuitry 126. Advantageously, the arrangement of feed structures integrated with the antenna body 102 enables transmitter and/or receiver circuitry to be integrated with the antenna.

Turning to FIGS. 4 and 5, an interior sidewall 130 of the body portion 102 includes corrugations 132. A set of the corrugations 132 is associated with each set of feed structures 110–116 and 118–124. The corrugations 132 are defined by a series alternating inwardly protruding portions 134 and recessed portions 136. A non-corrugated (or substantially smooth) sidewall portion 138 is axially disposed to interconnect adjacent sets of the corrugations 132. The corrugations 132 can extend circumferentially around the entire interior sidewall of the body 102, as shown in FIG. 3, for example. Alternatively, each feed structure 110–124 can include corrugations 132 configured as circumferentially extending features having arc lengths that approximate the circumferential arc length of each respective feed structure.

Each of the feed structures 110–124 includes one or more feed elements operative to propagate electromagnetic waves for a desired center frequency. In the example of FIGS. 3–5, each of the feed structures 110–124 are depicted as waveguide feed structures that propagate electromagnetic energy through apertures (or slots) 140 located in recessed portions 136 of the corrugations 132. The number of apertures for each coupling waveguide, which can be one or more, depends on the frequency range supported by the set of associated feed structures. The apertures 140 extend through the interior sidewall 130 of the antenna body 102 providing a path into the associated waveguide feed structures 110–124. The apertures 140 can be in the form of slots, holes, and can have different shapes, such as rectangular or curved openings.

In accordance with an aspect of the present invention, the locations of the apertures are determined by virtual short circuit locations $S1_A$, $S1_B$, $S1_C$, $S1_D$, $S2_A$, $S2_B$, $S2_C$, and $S2_D$ corresponding to desired center frequencies. As described herein, each short circuit location is axially positioned for a diameter corresponding to a desired center frequency. The corrugations 132, including the apertures 140, are located at positions based on the determined short circuit locations. In this example, where the feed structures 110–124 are themselves waveguide feeds, each aperture 140 is positioned about one-quarter wavelength axially spaced up the antenna structure 100 from a respective short circuit location.

Each aperture 140 is dimensioned and configured to be sufficiently large to pass the lowest frequency within the bandwidth of each respective center frequency for which it is located. Additionally, each of the waveguide feed structures 110–124 tapers along with the flare angle of the body portion 102. With respect to the feed structure 110, for example, the width of the feed structure down the horn (e.g., at 142 corresponding to a higher frequency) is less than the width of the feed structure at an upper location of the antenna (e.g., at 144 corresponding to a lower frequency). The other waveguide feed structures 112–124 can be similarly configured. In this way, the apertures 140 cooperate with the respective waveguide feed structures 110–124 to filter electromagnetic energy within a limited bandwidth according to the selected center frequencies.

By way of example, for incoming signals received at the antenna structure 100 traveling from the end 104 toward the end 106, higher frequencies are allowed to pass down the horn. Lower frequencies are blocked from traveling down the antenna 100, as they propagate through the apertures 140 and low-frequency feed structures to associated circuitry 126 (FIG. 3). Thus, those skilled in the art will understand and appreciate that each of the apertures 140 is located to facilitate propagation of electromagnetic energy for a set of frequencies having a predetermined bandwidth centered about a respective center frequency. As a result, each set of feed structures, which include plural apertures, can be configured to support propagation of electromagnetic energy for substantially any desired frequency band in accordance with an aspect of the present invention.

While the example in FIGS. 3–5 shows two axial sets of feed structures 110–116 and 118–124, each set supporting propagation of electromagnetic energy for a desired frequency band, those skilled in the art will understand and appreciate that the antenna 100 can be designed to support any number of one or more frequency bands. Additionally, the number of center frequencies and the bandwidth associated with each center frequency can be adapted to support a desired frequency band at each respective set of feed structures 110–116 and 118–124 in accordance with an aspect of the present invention.

Figure 6:
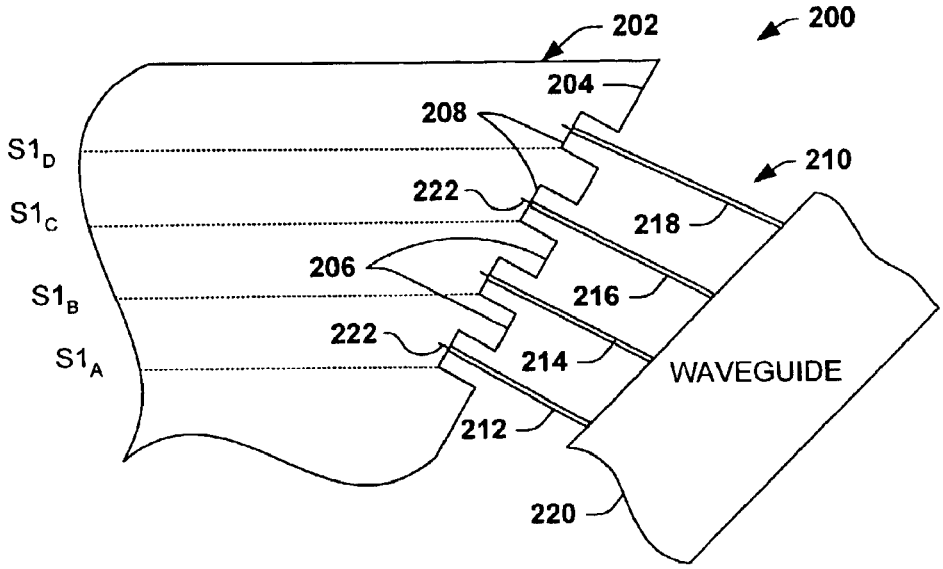
FIG. 6 is a partial section view of part of a waveguide antenna illustrating another type of feed system that can be used in accordance with an aspect of the present invention.

As mentioned above, various types of feed elements can be utilized to feed a horn antenna structure in accordance with an aspect of the present invention. FIG. 6 is a partial sectional view of a waveguide horn antenna structure 200 in accordance with an aspect of the present invention. The antenna structure 200 includes a horn-shaped body 202, such as described herein. Briefly stated, an interior sidewall portion 204 the body 202 is corrugated to include a series of alternating slots 206 and protrusions 208.

The antenna 200 also includes plural feed structures, one of which, indicated at 210, is depicted in FIG. 6. The feed structure 210 in this example includes a plurality of probe feed elements 212, 214, 216 and 218. The probe feed elements 212–218 include coaxial input connections between a waveguide or other circuitry 220 and the interior of the antenna body 202. Each of the probe feed elements 212–218 terminate in a probe tip 222 that protrudes into an interior of the antenna body 202. The tips 222 can be formed of an electrically conductive material, a semiconductor material, or other materials as known in the art. In the example of FIG. 6, the tips 222 extend generally radially inwardly through ends of the protrusions 208 of the corrugated sidewall 204.

Figure 7:
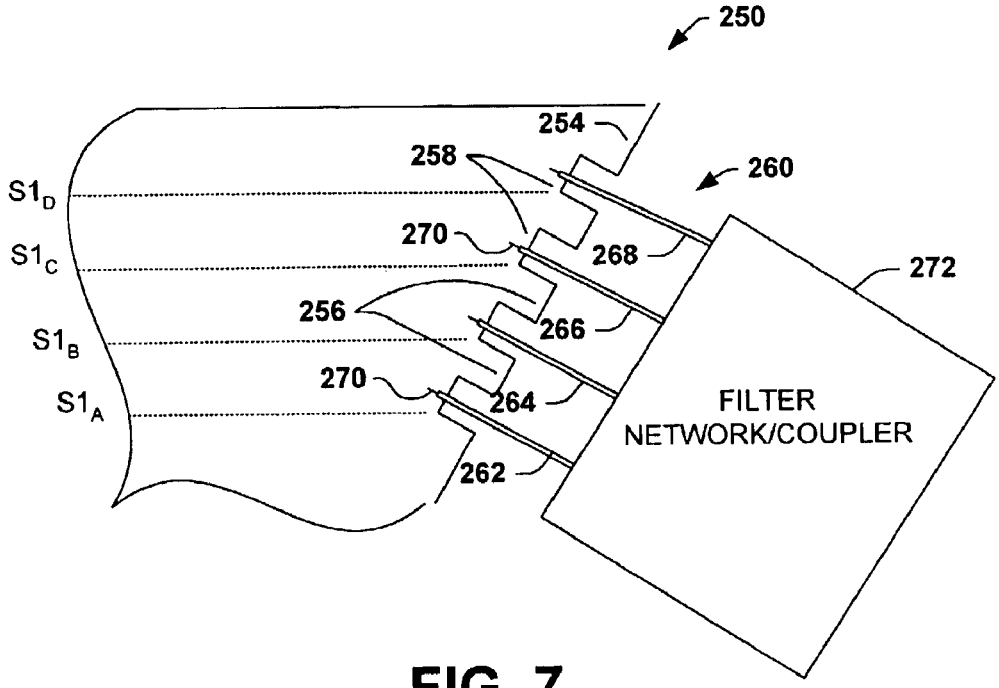
FIG. 7 is a partial section view of part of a waveguide antenna illustrating yet another type of feed system that can be used in accordance with an aspect of the present invention.

In accordance with an aspect of the present invention, the respective tips 222 are positioned based on the corresponding virtual short circuit locations $S1_A$, $S1_B$, $S1_C$ and $S1_D$. As mentioned above, the short circuit locations $S1_A$, $S1_B$, $S1_C$ and $S1_D$ correspond to diameters determined as a function of desired spaced apart center frequencies selected within a frequency band to be supported by the feed structure 210. To feed a given frequency, appropriate filters are associated with the corrugations at the corresponding short circuit locations. In the example of FIG. 7, the feed locations of the feed elements 212–218 are positioned one-quarter wavelength up the antenna from their associated short circuit locations $S1_A$, $S1_B$, $S1_C$ and $S1_D$.

In this example, each of the coaxial inputs of the probe feed elements 212–218 are formed of electrically conductive material (e.g., a coaxial cable or wire or other conductor) having a different length, which defines a corresponding filter to facilitate propagation of electromagnetic energy between the antenna body 202 and the other circuitry 220. That is, the length of each conductor is selected for each probe feed element 212–218 to support propagation of electromagnetic energy within a limited range of frequencies having a bandwidth centered about a respective center frequency. In this way, the feed structure 210 can support propagation of substantially all the frequencies within an associated broad frequency band, which is defined by the collective frequencies supported by the associated feed elements 212–218.

FIG. 7 depicts a partial sectional view of a waveguide horn antenna structure 250, in accordance with an aspect of the present invention, which is similar to that shown and described with respect to FIG. 6. Briefly stated, the antenna 250 includes a horn-shaped body 252 and an interior sidewall portion 254, which is corrugated to include a series of alternating slots 256 and protrusions 258. One of several feed structures that can be implemented on the antenna structure 250 is depicted at 260. The feed structure 260 in this example includes a plurality of probe feed elements 262, 264, 266 and 268. The probe feed elements 262, 264, 266 and 268 terminate with corresponding probe tips 270 to facilitate propagation of electromagnetic energy between the interior of the antenna 250 and an associated filter network 272. The probe tips 270 are connected within protrusions 258 of the corrugated sidewall portion 254.

In this example, the probe elements are specifically configured to define filters. The coaxial connections can be substantially equidistant in length or have otherwise arbitrary known lengths. The filter network 272 is associated with each of the feed elements 262, 264, 266 and 268, and is programmed and/or configured to perform desired filtering. The filter network 272 thus is operative to propagate desired frequencies for each of the feed elements according to their corresponding short circuit locations and to allow higher frequencies (not supported by the feed structure 260) to pass down the antenna structure 250. The filter network 272 can include additional couplers for coupling electromagnetic waves from the electrically conductive feed elements 262, 264, 266 and 268 to one or more associated waveguides (not shown). The position of the feed elements 262–268 as well as the recesses 256 and protrusions 258 can be set based on corresponding virtual short circuit locations $S1_A$, $S1_B$, $S1_C$ and $S1_D$, such as described herein.

Figure 8:
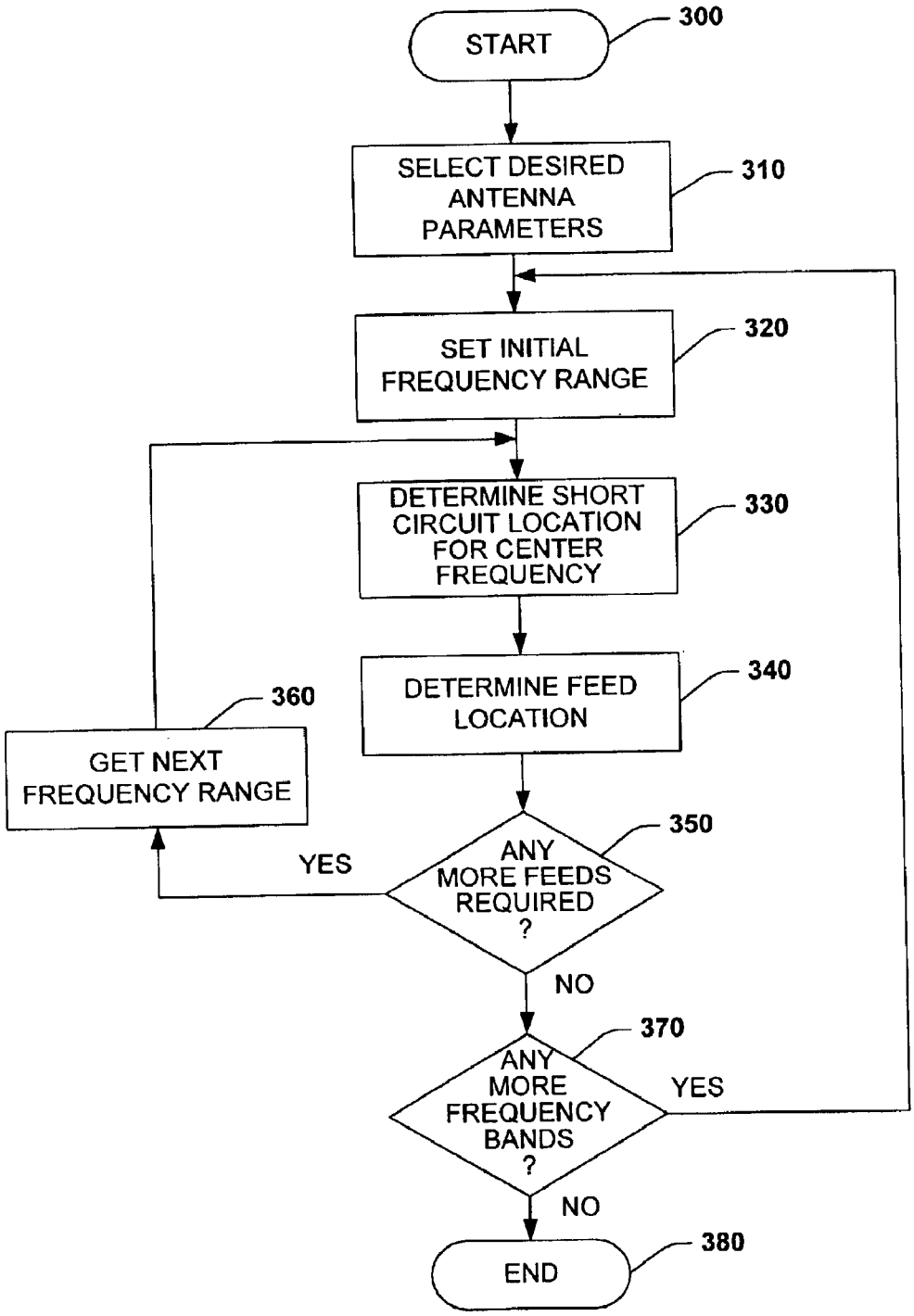
FIG. 8 is a flow diagram illustrating a methodology for designing a waveguide antenna in accordance with an aspect of the present invention.

In view of the examples shown and described above, a methodology that can be implemented in accordance with the present invention will be better appreciated with reference to the flow diagram of FIG. 8. While, for purposes of simplicity of explanation, the methodology is shown and described as a executing serially, it is to be understood and appreciated that the present invention is not limited by the order shown, as some aspects may, in accordance with the present invention, occur in different orders and/or concurrently from that shown and described herein. Moreover, not all features shown or described may be needed to implement a methodology in accordance with the present invention. Those skilled in the art will further understand that the methodology can be implemented manually or as a computer implemented method programmed to determine desired antenna design parameters based on user inputs.

The methodology begins at 300, such as in conjunction with beginning to design a desired waveguide horn antenna structure in accordance with an aspect of the present invention. At 310, desired antenna parameters are selected. For example, such parameters can include a desired frequency band or bands to be supported by the antenna structure. As mentioned above, the antenna structure includes one or more feed structures configured to support propagation of limited frequency bands, which collectively determine the frequency range supported by the entire antenna structure. Additionally, a desired flare angle is set for the antenna structure. The flare angle can vary depending on various design factors, including size constraints for the antenna, desired gain, and so forth. Within each feed structure, a bandwidth associated with each feed element also can be selected, such as, for example, a 10% bandwidth relative to a center frequency. Thus, the selected bandwidth for each feed element will determine the number of feed elements needed to support a given frequency band for each feed structure.

At 320, based on the parameters selected at 310, an initial frequency range is set. The initial frequency range typically corresponds to the highest frequency range to be supported by the antenna structure. In this way, it provides a starting point for the antenna design, and the methodology can be utilized to design up the antenna structure (or down in frequency).

At 330, a short circuit location is determined for the frequency range set at 320 (or as subsequently set in the methodology). The short circuit location along the body of the antenna is determined to correspond to a diameter of the antenna body as a function of the frequency range, such as defined by Eq. 2. For the highest frequency supported by the antenna, the short circuit location can correspond to a zero initial axial position, although it alternatively could correspond to a position axially spaced apart from the end of the antenna structure. For other short circuit locations, the location can be determined according to Eq. 3.

Next, at 340, a feed location associated with the short circuit location is determined. The feed location is determined as a function of the waveguide wavelength for the short circuit location. For example, the feed location corresponds to a position up the antenna (e.g., down in frequency) that is one-quarter wavelength (in waveguide wavelength) above the short circuit location determined at 330.

At 350, a determination is made as to whether the there is a next frequency in the present frequency range that may require a feed or coupling. As mentioned above, the number of feeds for a given frequency band will generally depend on the center frequency bandwidth and the size of the feed structure's frequency band. By way of example, two coupling (or feed) locations are typically used for linear polarization and four locations for circular polarization at each frequency range. If the determination at 350 is positive, indicating more feeds may be needed, the methodology proceeds to 360. At 360, the next frequency is determined, such as by subtracting the bandwidth from the previous frequency for which a feed location was just determined at 340. While a constant frequency bandwidth is typically used within each feed structure, those skilled in the art will understand and appreciate that each feed element can employ a different bandwidth in accordance with an aspect of the present invention. From 360, the methodology returns to 330 for determining corresponding short circuit and feed locations according to the frequency determined at 360.

If the determination at 350 is negative, indicating that sufficient feeds have been determined for the frequency band, the methodology proceeds to 370. At 370, a determination is made as to whether there are any additional frequency bands that are to be supported by the antenna, such as based on the antenna design parameters selected at 310. If there are any additional frequency bands, the methodology returns to 320 for determining corresponding short circuit and feed locations for the next frequency band. If, at 370, there are no additional frequency bands, the methodology can proceed from 370 to 380 and, in turn, end.

With the feed locations determined, an interior of the antenna body will include corrugations or slots along an interior portion thereof. The dimensions and configuration of the corrugations and slots will vary as a function of the respective center frequencies and feed locations determined in the foregoing methodology. Additionally, appropriate types of feeds, such as probes, slots or loops, can be utilized for integration into the antenna structure in accordance with an aspect of the present invention.

From the above, those skilled in the art will understand and appreciate that any frequency set can be incorporated into a given horn antenna structure provided that the flare angel provides a cutoff frequency one-quarter wavelength behind the frequency. For example, the same horn antenna structure configured in accordance with an aspect of the present invention can support both 2 GHz and 60 GHz.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. For example, a waveguide horn antenna structure implemented in accordance with an aspect of the present invention can utilize more than one type of feed element. By way of further example, it may be desirable to employ a waveguide type of feed structure (e.g., shown in FIGS. 3–5) for higher frequencies and use a probe type of feed structure (e.g., shown in FIGS. 6 and 7) for lower frequencies. Accordingly, the present invention is intended to embrace all such alterations, modifications and variations that fall within the spirit and scope of the appended claims.

What is claimed is:

1. A waveguide antenna structure, comprising:

a body portion having first and second ends spaced apart by a sidewall extending between first and second ends, the first end having a cross-sectional dimension that is less than a cross-sectional dimension of the second end; and at least one feed structure including axially spaced apart feed locations along the sidewall of the body portion to facilitate propagating electromagnetic energy through the sidewall for desired frequencies within a frequency range of the at least one feed structure.

2. The antenna structure of claim 1, the feed locations being determined as a function of respective short circuit locations, each short circuit location depending on a respective center frequency selected within the frequency range.

3. The antenna structure of claim 2, the sidewall of the body portion having an inner diameter for a first short circuit location that is inversely proportional to a highest center frequency within the frequency range.

4. The antenna structure of claim 3, the sidewall of the body portion having a flare angle θ, adjacent center frequencies within the frequency range being separated by a center frequency bandwidth, remaining short circuit locations for lower center frequencies in the at least one feed structure having an axial position $S_n$ defined by $$S_n = \frac{\frac{d_n - d_{n-1}}{2}}{\tan\theta}$$

where:

n is a positive integer;

$d_n$=diameter at short circuit location n; and $d_{n-1}$=diameter at short circuit location n−1.

5. The antenna structure of claim 1, the body portion further comprising a corrugated horn antenna structure.

6. The antenna structure of claim 5, the corrugated horn antenna structure including generally circumferentially extending corrugations along an interior sidewall portion thereof.

7. The antenna structure of claim 6, each of the corrugations being dimensioned and configured according to a desired center frequency.

8. The antenna structure of claim 6, the corrugations further comprising alternating protruding and recessed portions, the feed locations being defined by apertures extending through the body portion of the horn antenna structure at recessed portions of the corrugations.

9. The antenna structure of claim 1, the at least one feed structure further comprising plural feed elements at the generally axially spaced apart feed locations, the feed elements comprising at least one of probes and slots operative to propagate electromagnetic energy within the frequency range relative to the body portion.

10. The antenna structure of claim 1, the at least one feed structure further comprising a first pair of feed structures, each feed structure in the first pair of feed structures having respective feed locations arranged along the body portion about 180 degrees out of phase with each other for propagating electromagnetic energy within the frequency range and having a first polarization.

11. The antenna structure of claim 10, the at least one feed structure further comprising a second pair of feed structures, each feed structure in the second pair of feed structures having respective feed locations arranged about 180 degrees out of phase with each other and about 90 degrees out of phase with the feed structures in the first pair of feed structures, the second pair of feed structures being operative to propagate electromagnetic energy within the frequency range and having a second polarization, which is different from the first polarization.

12. The antenna structure of claim 11, the first and second pairs of feed structures defining a first set of feed structures, the antenna structure further comprising at least another set of feed structures axially spaced apart from the first set of feed structures for propagating electromagnetic energy within another frequency range, which is different from the frequency range supported by the first set of feed structures.

13. A waveguide antenna structure, comprising:

horn-shaped means for propagating electromagnetic waves relative to free space, the horn-shaped means having spaced apart ends and a longitudinal central axis extending through the ends; and means for feeding the horn-shaped means at a plurality of generally axially spaced apart feed locations to facilitate propagating electromagnetic energy at desired frequencies within at least one frequency range.

14. The antenna structure of claim 13, each of the feed locations being determined as a function of a respective short circuit location functionally related to an associated center frequency within the at least one frequency range.

15. The antenna structure of claim 14, the horn shaped means having an inner cross-sectional dimension for a first short circuit location that is inversely proportional to a highest center frequency within the at least one frequency range.

16. The antenna structure of claim 13, the horn-shaped means further comprising generally circumferentially extending corrugations along an interior portion of a side-wall of the horn-shaped means.

17. The antenna structure of claim 16, each of the corrugations being dimensioned and configured according to a respective center frequency and associated center frequency bandwidth to facilitate propagation of electromagnetic energy through an associated feed location at frequencies within the respective center frequency bandwidth.

18. The antenna structure of claim 17, the means for feeding further comprising at least one of a slot feed element and a probe feed element at each of the feed locations.

19. The antenna structure of claim 13, the means for feeding further comprising at least a first pair of feed structures, each feed structure in the first pair of feed structures having respective means for feeding the horn-shaped means at axially spaced apart feed locations arranged along the horn-shaped means about 180 degrees out of phase from each other for propagating electromagnetic energy within a first frequency range and having a first polarization.

20. The antenna structure of claim 19, the means for feeding further comprising a second pair of feed structures, each feed structure in the second pair of feed structures having respective means for feeding the horn-shaped means at axially spaced apart feed locations arranged along the horn-shaped means about 180 degrees out of phase from each other and about 90 degrees out of phase with the respective feed structures in the first pair of feed structures, the respective means for feeding of the second pair of feed structures being operative to propagate electromagnetic energy within the first frequency range and having a second polarization, which is different from the first polarization.

21. The antenna structure of claim 20, the first and second pairs of feed structures defining a first set of feed structures, the means for feeding further comprising at least another set of feed structures axially spaced apart from the first set of feed structures for propagating electromagnetic energy within a second frequency range, which is different from the first frequency range.

22. A method for feeding a waveguide horn antenna having a horn-shaped body portion, the method comprising:

determining a short circuit location along a length of the horn-shaped body portion associated with a desired center frequency;

determining a feed location spaced axially a predetermined distance from the short circuit location to facilitate propagating electromagnetic energy for a bandwidth centered about the desired center frequency; and repeating each of the determining steps to provide a number of feed locations sufficient to enable the waveguide horn antenna to propagate electromagnetic energy at frequencies within at least one frequency range supported by the number of feed locations.

23. The method of claim 22, further comprising:

arranging at least a first pair of feed structures along the body portion at about 180 degrees out of phase from each other, each feed structure in the first pair of feed structures comprising feed elements operative to facilitate propagating electromagnetic energy at a respective feed location for the respective bandwidth.

24. The method of claim 23, further comprising:

arranging at least a second pair of feed structures along the body portion at about 180 degrees out of phase from each other and 90 degrees out of phase from the feed structures in the first pair of feed structures, each feed structure in the second pair of feed structures comprising feed elements operative to facilitate propagating electromagnetic energy at a respective feed location for the respective bandwidth.

* * * * *